US008041240B2

(12) United States Patent
Wagner

(10) Patent No.: US 8,041,240 B2
(45) Date of Patent: Oct. 18, 2011

(54) CLOSED LOOP CHARGE CONTROL TO MINIMIZE LOW FREQUENCY CHARGE NON-UNIFORMITY

(75) Inventor: Moritz Patrick Wagner, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 545 days.

(21) Appl. No.: 12/190,335

(22) Filed: Aug. 12, 2008

(65) Prior Publication Data

US 2010/0040388 A1 Feb. 18, 2010

(51) Int. Cl.
*G03G 15/00* (2006.01)

(52) U.S. Cl. ..... 399/48; 399/73

(58) Field of Classification Search ..... 399/48, 399/50, 73

See application file for complete search history.

(56) References Cited

U.S. PATENT DOCUMENTS

| | | | | |
|---|---|---|---|---|
| 4,417,804 | A | 11/1983 | Werner | |
| 5,937,224 | A * | 8/1999 | Budnik et al. | 399/26 |
| 6,493,524 | B2 * | 12/2002 | Kamiya | 399/48 |
| 2001/0033754 | A1 * | 10/2001 | Asai | 399/46 |

* cited by examiner

*Primary Examiner* — David Gray
*Assistant Examiner* — Roy Y Yi
(74) *Attorney, Agent, or Firm* — Matthew C. Loppnow; Prass LLP

(57) ABSTRACT

This is a system to improve final xerographic image by providing uniformity in both pre-imaged and imaged photoconductive drums or belts. An ESV is placed after the exposure imaging station so that it can measure the voltage on the photoreceptor (PR) belt or drum obtaining a periodic photoreceptor signature. This signature is communicated to a controller and stored therein. After both pre-imaged and imaged signatures are obtained, the controller compensates for these signatures to all imaging runs thereafter to ensure uniform voltage and thereby uniform final images.

13 Claims, 2 Drawing Sheets

CLOSED LOOP CHARGE CONTROL TO MINIMIZE LOW FREQUENCY CHARGE NON-UNIFORMITY

This invention relates to electrostatic imaging methods and, more specifically, to controlling the charging step to ensure image quality and consistency.

BACKGROUND

In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted from the carrier particles by the charge pattern of the image areas on the photoconductive insulating area to form a powder image on the photoconductive insulating area. This image may be subsequently transferred or marked onto a support surface such as copy paper to which it may be permanently affixed by heating and/or by the application of pressure. Following transfer of the toner image or marking, the copy paper may be removed from the system by a user or may be automatically forwarded to a finishing station where the copies may be collected, compiled and stapled and formed into books, pamphlets or other sets.

Image consistency is important whether the copies are collected or compiled and formed into books, pamphlets, etc. One important property of print quality is the uniformity of the print. Many parameters of the xerographic process affect print uniformity, but one of the most important ones is charge uniformity since that is where the process starts. Measurements taken on drums with electrostatic volt meters show that the charge uniformity on the drum is periodic with the drum and very predictable. These measurements also show that the PR voltage patterns are very similar in shape and amplitude for all halftone prints and the solid print, i.e. from zero to full discharge. The present invention proposes to measure the PR voltage pattern during a number of drum (or belt) revolutions at the charge and latent imaging levels, store the observed voltage pattern and correct it by adjusting the charge device so that it is essentially constant. The measurement of the charge and discharge patterns can be repeated as needed to accommodate changes in the pattern over time.

There have been some attempts to control the charging step of the electrostatic process such as that disclosed by U.S. Pat. No. 4,417,804 (Werner). The Werner invention is concerned with a photoreceptor voltage control comprising a comparator circuit for determining the error between the photoreceptor voltage and the desired voltage. The photoreceptor voltage is detected by a non-contacting detector and the photoreceptor voltage signal is fed directly to the comparator circuit which determines if the error is too positive, too negative or within acceptable limits. This information is then fed by a DC isolation system to the machine logic control which in turn corrects a corona supply voltage to obtain the desired photoreceptor voltage. In Werner, his voltage detector 18 is placed immediately after the charging station 12, thereby establishing a desirable voltage of the photoreceptor only after this charging step. One disadvantage of the Werner control system is that the voltage detector is fully dedicated to the charge system and its control loop and the correction performed is reactive and always a little delayed because of the sensor position after the charge device. This invention is proposing a predictive control method by measuring the PR voltage pattern before printing starts, store the pattern, and adjust the charge output exactly as needed. Another advantage of this system over the Werner system is that the Werner system looks solely at the charge voltage, whereas this invention can also measure exposed areas of the photoreceptor which can be more optimal for achieving uniform print quality.

SUMMARY

It is therefore important to provide a more precise voltage control to not only measure the initial PR charge uniformity but also to provide a uniform voltage at the half-tone latent image voltage level. This system also does not require a separate and dedicated voltage sensor but uses the customarily used voltage sensor before the development station.

The structure of the present system and apparatus comprises the conventional xerographic stations, i.e. charging station, exposure station, development station, transfer and detack station, fusing station and cleaning station. The Electro-Static Volt meter (ESV) is placed after the exposure station, set at a constant charge output and is enabled to obtain after a plurality of revolutions the PR voltage average (or signature). This signature is obtained, stored and then used during run time to adjust the charge output to correct for inherent PR charge non-uniformities.

Several PR signatures may be obtained by exposing the photoreceptor to different halftone levels and measuring the voltage pattern. In some applications it may be advantageous to use for example a 50% halftone or a solid (100% halftone) for which to correct instead of just using the charge level (0% halftone) All of these photoreceptor signatures are stored in a controller, which in turn corrects subsequent PR voltages by adjusting the charge level to conform with one or more signature(s) and obtain the desired voltage of both the imaged and non-imaged photoreceptor.

To obtain maximum signatures of both above, a plurality (i.e. more than 5) revolutions are run; the greater number of revolutions the more precise average or signature is obtained, i.e., a signature after 30 runs should be more precise than one obtained after 5 runs. Both these signatures are stored in a logic control and fed to the charging device to ensure every run or revolution thereafter is constant to conform to each of the two signatures, the non-imaged PR voltage and the latent imaged PR voltage. By controlling both these voltages, a significantly more uniform image than heretofore obtainable is provided.

A main advantage of the present process is that the photoreceptor charge pattern is measurable, consistent over time, and can therefore be compensated for by controlling the current/voltage driven to the PR both when imaged and non-imaged. An important feature of the present process or system is to set the charge station at a constant charge output (open loop) and to measure the PR signature for several (more than 5) revolutions and store the average voltage (signature). This signature is then used during run time to adjust the charge output to correct for inherent process direction non-uniformities in the PR (including charge non-uniformities due to the run out of the PR).

If the charge voltage is kept uniform at both the charging and imaging stations, the voltage at the halftone level will always be uniform. This is accomplished by locating the ESV sensor after the imaging station (typical ESV position for other control purposes as well), and to take one reading at cycle up (PR signature) and the other reading after the latent image (voltage pattern) is deposited on the PR (image signature). The storage controller can include any suitable software and hardware that is capable of:

A. storing the signatures;

B. comparing the PR voltage of each run and correcting each voltage to comply with the signatures of both the non-exposed PR and the latent imaged PR;

C. After initial charging cycle up, the PR voltage is measured after several runs and stored and recorded in this controller.

In one embodiment, this controller adjusts the charge device output to compensate for any non-uniformity in the voltage recorded during cycle up. During printing, the charge level is adjusted by changing the grid voltage of the scorotron, keeping the charge level on the photoreceptor constant. By "plurality" of runs is meant at least 5 runs. By electrostatic drum is meant either an electrostatic drum or electrostatic endless belt. The more runs, the more accurate the signature.

The ESV of this invention has a dual purpose:

1. To measure voltage to obtain the PR signatures which are then stored.
2. To be used in the general control system to adjust xerographic parameters.

It is critical to this invention that the voltage meter ESV be located immediately after the exposure-imaging station in order to be able to obtain signatures of both an imaged and unimaged photoreceptor or photoconductor.

DETAILED DESCRIPTION OF THE DRAWING

Figure 1:
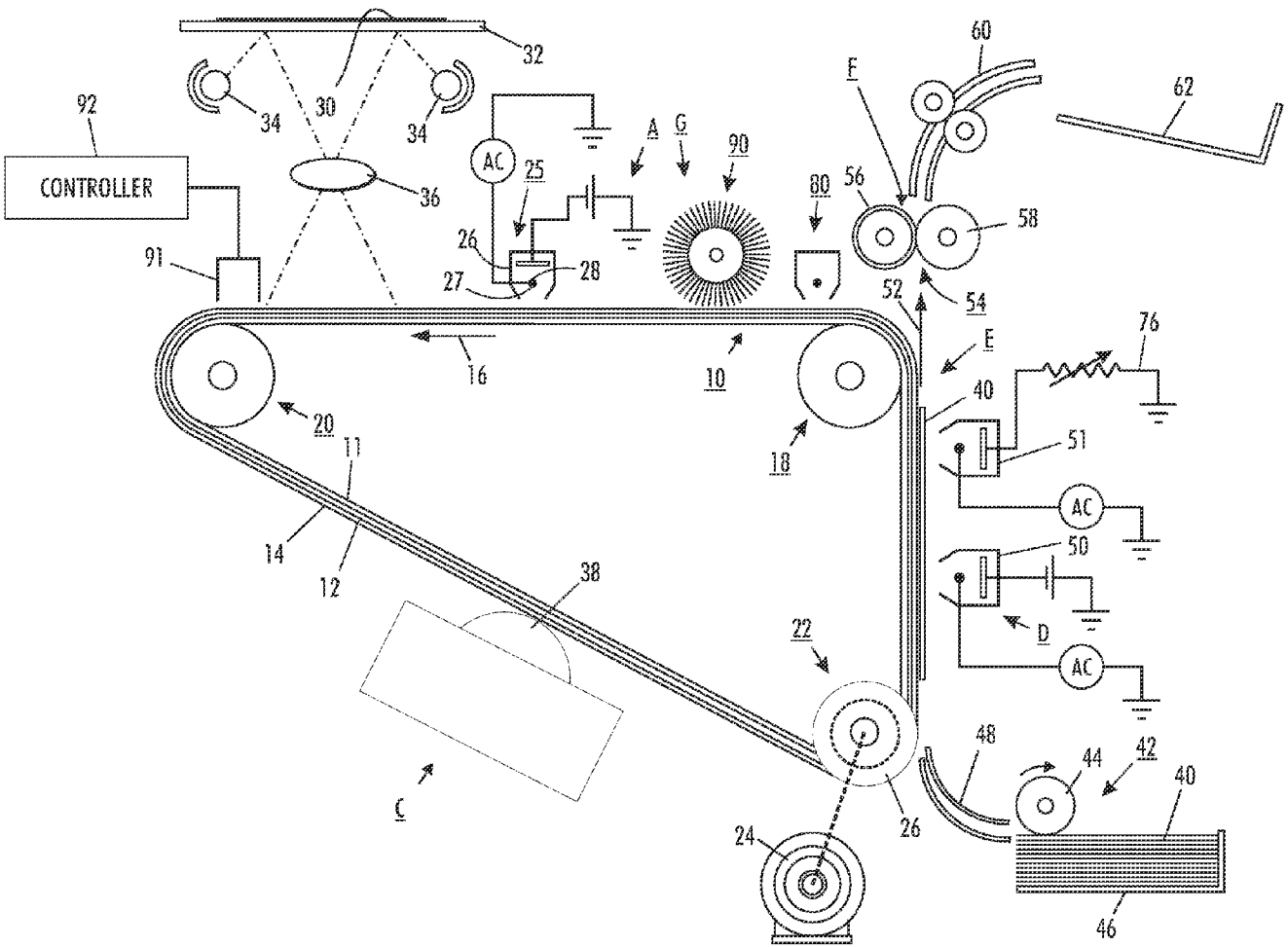
FIG. 1 illustrates a schematic of an endless belt electrostatic imaging process with the electrostatic volt meter (ESV) in place after the imaging and exposure station.
Figure 2:
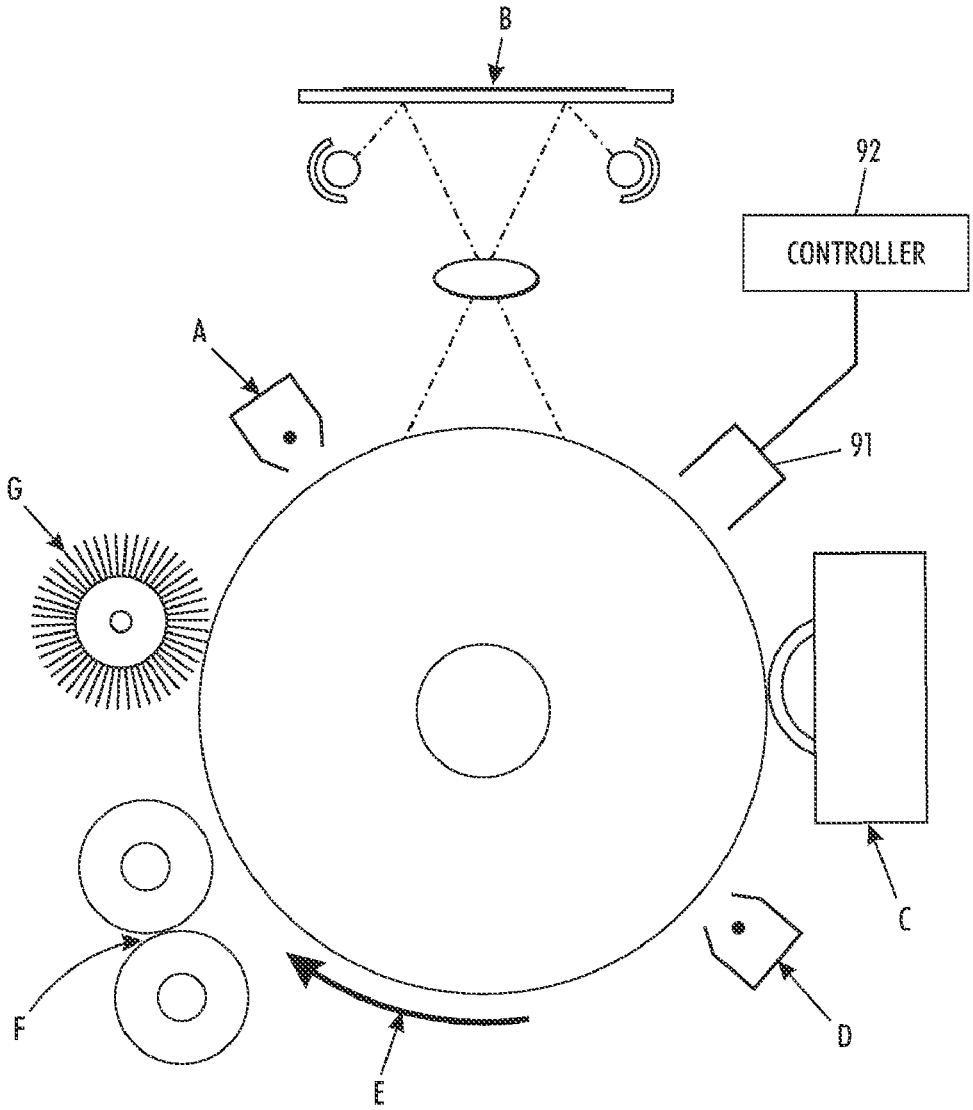
FIG. 2 illustrates a drum type electrostatic marking system with the ESV in place after the imaging and exposure station.

In FIG. 1 the specifics of a Xerographic system of an endless photoreceptor belt are described in detail. In FIG. 2 only the Xerographic stations of a photoconductive drum are shown together with the critical placement of the ESV used in the present invention. In FIG. 1 the following numbers designate the following elements: 10—photoconductive belt; 11—electrically conductive substrate; 12—charge generator layer; 13—photoconductive particles dispersed in electrically insulating organic resin; 14—charge transport layer; 16—directional arrow; 18—stripping roller; 20—tension roller; 22—drive roller; 24—motor; 25—corona device; 26—conductive shield; 27—dicorotron electrode comprised of elongated bare wire; 28—electrically insulating layer; 30—original document; 32—transparent platen; 34—lamps; 36—lens; 38—magnetic brush developer roller; 40—sheet of support material; 42—sheet feeding apparatus; 44—feed roll; 46—stack; 48—chute; 50—corona generating device; 51—detack corona generating device; 52—directional arrow; 54—fuser assembly; 56—heated fuser roller; 58—backup roller; 60—fusing sheet; 62—catch tray; 76—resistor; 78—dode; 80—shield circuit of a preclean dicorotron; 90—conventional cleaning; 91—ESV of this invention; 92—controller of this invention. The following xerographic stations are illustrated for both FIG. 1 and FIG. 2: A—charging; B—imaging or exposure station; C—development station; D—transfer station; E—detack station; F—fusing station; G—cleaning station. The sequential xerographic stations A-G in FIG. 2 are the same as the stations in FIG. 1, with the necessary placement of the ESV shown in both figures to b after the exposure or imaging station.

It is critical to this invention that the voltage meter be located just after the exposure station in order to obtain signatures of both the imaged and unimaged PR.

In summary, embodiments of this invention provide a method for controlling the charge uniformity of a photoreceptor (PR) in an electrostatic marking system. This system or method comprises running a plurality of xerographic drum or belt rotations or revolutions (run(s)) keeping the charge voltage output constant and measuring the voltage via an electrostatic voltage meter (ESV) on the photoreceptor at a given point; recording said voltage for each run and averaging the recorded voltages to obtain thereby a precise voltage signature; storing the voltage signature in a controller, the controller configured to calculate the difference between the desired voltage and the measured voltage signature at a given position on the photoreceptor, correcting the charge output for that position on the photoreceptor during subsequent imaging runs to thereby ensure a consistent voltage on the photoreceptor. The controller is enabled to apply the precise voltage signature to a charging unit and compensate for any charge voltage deviation and voltage uniformity from the signature.

The noted given point on the photoreceptor is before a latent image is formed on the photoreceptor to obtain thereby an unimaged PR signature. The noted given point on the photoreceptor is after a latent image is formed on the photoreceptor to obtain thereby a latent imaged PR signature.

The controller is enabled to provide a constant uniform voltage or signature to all imaging runs subsequent to averaging and the establishing of said signature. When the signature is obtained on the PR after a latent image has been formed, the controller is thereby configured to supply a development station with a precise and uniform photoreceptor voltage which in turn will apply a uniform amount of toner to the latent image. The ESV is positioned in the electrostatic marking system between an exposure station and a development station and in electrical connection to the controller. The ESV is enabled to measure both imaged and unimaged portions of the PR and configured to convey this measurement to the controller for both storage and subsequent charge applications to imaging runs conducted after the signature(s) is obtained. The exposure station can comprise a conventional corotron or a raster output scanner (ROS).

The ESV is used to both measure voltage during the signature formation and to measure and correct voltage during subsequent imaging runs to determine deviations from the desired photoreceptor voltage. A charging station can be regulated by the controller to maintain a desired constant PR voltage both before and after a latent image is formed, to provide thereby two signatures, a pre-imaged signature and a latent image signature. At least 5 drum or belt revolutions are used to calculate the signatures. It is preferred that from 5 to 50 drum or belt revolutions are used to calculate the signatures.

The electrostatic marking apparatus of this invention comprises a rotating photoreceptor and, in sequential order, a charging station, an exposure imaging station, a development station, a transfer station, and a fusing station. There is a voltage meter positioned in the marking apparatus after the exposure station but before said development station. The voltage meter (ESV) is in electrical connection to a controller and configured to communicate photoreceptor (PR) voltage measurements to the controller after a plurality of cycle rotations of the photoreceptor averaged to form thereby a PR voltage signature. The control is configured to receive and store the signature and to subsequently apply the corrected voltage signature to the photoreceptor to ensure a constant and uniform voltage to said PR during imaging. The voltage meter is configured to measure a voltage on the PR before and after a latent electrostatic image is formed on the photoreceptor. The controller is enabled to control the charge voltage on the PR after a latent electrostatic image is formed thereon and thereby control the amount of toner to be applied to the latent electrostatic image at the development station.

In one embodiment of this invention, the following is provided:

1. Measure the photoreceptor (PR) voltage under constant charge output for several revolutions and store the voltage as a function of the photoreceptor position. There is likely to be some data processing performed such as averaging at a given photoreceptor position to reduce the noise in the data. The controller now has the data of the voltage on the photoreceptor as a function of the position which is called "the photoreceptor signature".
2. During printing, a machine controller will determine a desired photoreceptor voltage and communicate it to the charge controller. Given that the relative position of the photoreceptor with respect to the charge device is known, the charge controller can now calculate the difference between the desired voltage and the voltage of the photoreceptor signature and adjust the charge output accordingly to achieve constant photoreceptor voltage.
3. The electrostatic volt meter (ESV) in this invention is not dedicated to controlling the charge device but is used by the machine controller for overall xerographic controls and is therefore not an additional part to the system.
4. Because the electrostatic volt meter is located after the exposure station, the photoreceptor signature may be measured at different halftone or continuous tone discharge levels depending on the desired control strategy. The charge controller then can extrapolate to the desired charge level and compensate for the photoreceptor signature as mentioned above.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for controlling the charge uniformity of a photoreceptor (PR) in an electrostatic marking system which comprises:

running a plurality of unimaged drum or belt rotations or revolutions (run(s)) keeping the charge voltage output constant during electrostatic marking system cycle up and measuring the unimaged voltage via an electrostatic voltage meter (ESV) on said photoreceptor at a given point before a latent image is formed on said photoreceptor;

recording said unimaged voltage for each unimaged run and averaging said unimaged voltages to obtain thereby an unimaged voltage signature as a function of the given point;

storing said unimaged voltage signature as a function of the given point in a controller;

storing said unimaged voltage signature as a function of the given point in a controller, said controller configured to calculate a difference between a desired unimaged voltage and the voltage of the photoreceptor latent imaged voltage signature and store and correct for the said unimaged voltage signature based on the difference between a desired unimaged voltage and the voltage of the photoreceptor unimaged voltage signature for subsequent imaging runs to thereby ensure a consistent unimaged voltage on the photoreceptor;

said controller enabled to apply the required corrections for the said unimaged voltage signature to a charging unit and compensate for any charge voltage deviation and run-uniformity from the desired photoreceptor unimaged voltage;

running a plurality of latent imaged drum or belt rotations or revolutions (run(s)) keeping the charge voltage output constant and measuring the latent imaged voltage via the ESV on said photoreceptor at the given point after a latent image is formed on said photoreceptor and including exposed areas of the photoreceptor;

recording said latent imaged voltage for each latent imaged run and averaging said latent imaged voltages to obtain thereby a latent imaged voltage signature as a function of the given point; and storing said latent imaged voltage signature as a function of the given point in the controller, said controller configured to calculate a difference between a desired latent imaged voltage and the voltage of the photoreceptor latent imaged voltage signature and store and correct for the said latent imaged voltage signature based on the difference between a desired latent imaged voltage and the voltage of the photoreceptor latent imaged voltage signature for subsequent imaging runs to thereby ensure a consistent latent imaged voltage on the photoreceptor, wherein said controller is enabled to apply the required corrections for the said latent imaged voltage signature to a charging unit and compensate for any charge voltage deviation and run-uniformity from the desired photoreceptor latent imaged voltage and to supply a development station with a precise and uniform photoreceptor voltage which in turn applies a uniform amount of toner to the latent image, wherein said ESV is positioned in said electrostatic marking system between an exposure station and a development station, and wherein the voltages are averaged over at least 5 drum or belt revolutions to calculate the signatures.

2. The method of claim 1 wherein said controller is enabled to provide a constant uniform voltage or signature to all imaging runs subsequent to the averaging establishing of said signature.

3. The method of claim 1 wherein said signature is obtained on said PR after a latent image has been formed, said controller thereby configured to supply a development station with a precise and uniform amount of toner to be applied on said latent image.

4. The method of claim 1 wherein said ESV is in electrical connection to said controller, said ESV enabled to measure both imaged and unimaged portions of said PR and configured to convey this measurement to said controller for both storage and charge applications to imaging runs conducted after said signature(s) is obtained.

5. The method of claim 1 wherein the electrostatic marking system includes an imaging station comprising a corona imaging station.

6. The method of claim 1 wherein the electrostatic marking system includes an imaging station comprising a raster output scanner (ROS).

7. The method of claim 1 wherein said ESV is used to both measure voltage during the signature formation, and to measure and correct voltage during subsequent imaging runs to determine deviations from said signature.

8. The method of claim 1 wherein a charging station can be regulated by said controller to maintain a constant PR voltage both before and after a latent image is formed, to provide thereby two signatures, a pre-imaged signature and a latent image signature.

9. The method of claim 1 wherein the voltages are averaged over from 5 to 50 drum or belt revolutions to calculate said signature.

10. The method of claim 1 wherein said photoreceptor is in the form of an endless belt.

11. An electrostatic marking apparatus comprising a rotating photoreceptor and sequentially a charging station, an exposure imaging station, a development station, a transfer station and a fusing station, a voltage meter positioned in said apparatus after said exposure station but before said development station, said voltage meter (ESV) in electrical connection to a controller and configured to communicate photoreceptor PR voltage measurements to said controller after a plurality of cycle up rotations of said photoreceptor averaged, to form thereby a PR voltage signature, said controller configured to receive and store said signature and to subsequently apply said voltage signature to said photoreceptor to ensure a constant and uniform voltage to said PR during imaging, wherein the controller is configured to run a plurality of unimaged drum or belt rotations or revolutions (run(s)) keeping the charge voltage output constant during electrostatic marking system cycle up and measuring the unimaged voltage via the ESV on said photoreceptor at a given point before a latent image is formed on said photoreceptor, record said unimaged voltage for each unimaged run and average said voltages to obtain thereby an unimaged voltage signature as a function of the given point, store said unimaged voltage signature as a function of the given point in a controller, store said unimaged voltage signature as a function of the given point in the controller, said controller configured to calculate a difference between a desired unimaged voltage and the voltage of the photoreceptor latent imaged voltage signature and store and correct for the said unimaged voltage signature based on the difference between a desired unimaged voltage and the voltage of the photoreceptor unimaged voltage signature for subsequent imaging runs to thereby ensure a consistent unimaged voltage on the photoreceptor, wherein said controller is enabled to apply the required corrections for the said unimaged voltage signature to a charging unit and compensate for any charge voltage deviation and run-uniformity from the desired photoreceptor unimaged voltage, wherein the controller is configured to run a plurality of latent imaged drum or belt rotations or revolutions (run(s)) keeping the charge voltage output constant and measure the latent imaged voltage via the ESV on said photoreceptor at the given point after a latent image is formed on said photoreceptor and including exposed areas of the photoreceptor;

record the latent imaged voltage for each latent imaged run and averaging said latent imaged voltages to obtain thereby a latent imaged voltage signature as a function of the given point, store said latent imaged voltage signature as a function of the given point in the controller, said controller configured to calculate a difference between a desired latent imaged voltage and the voltage of the photoreceptor latent imaged voltage signature and store and correct for the said latent imaged voltage signature based on the difference between a desired latent imaged voltage and the voltage of the photoreceptor latent imaged voltage signature for subsequent imaging runs to thereby ensure a consistent latent imaged voltage on the photoreceptor, said controller enabled to apply the required corrections for the said latent imaged voltage signature to a charging unit and compensate for any charge voltage deviation and run-uniformity from the desired photoreceptor latent imaged voltage and to supply a development station with a precise and uniform photoreceptor voltage which in turn applies a uniform amount of toner to the latent image, wherein said ESV is positioned in said electrostatic marking system between an exposure station and a development station, and wherein the voltages are averaged over at least 5 drum or belt revolutions to calculate the signatures.

12. The apparatus of claim 11 wherein said voltage meter is configured to measure a voltage on said PR before and after a latent electrostatic image is formed on said photoreceptor.

13. The apparatus of claim 11 wherein said controller is enabled to control the charge voltage on said PR after a latent electrostatic image is formed thereon and thereby control an amount of toner to be applied to said latent electrostatic image at said development station.

* * * * *